United States Patent [19]

Kishino et al.

[11] 4,045,704

[45] Aug. 30, 1977

[54] MULTI-DIGIT FLUORESCENT DISPLAY TUBE WITH DIFFERENTLY SPACED PLANAR CONTROL GRID SECTIONS

[75] Inventors: Takao Kishino; Yukihiko Utamura, both of Mobara, Japan

[73] Assignee: Futaba Denshi Kogyo K. K., Japan

[21] Appl. No.: 694,666

[22] Filed: June 10, 1976

[30] Foreign Application Priority Data

June 13, 1975 Japan ..... 50-79388
June 13, 1975 Japan ..... 50-79389

[51] Int. Cl.[2] ..... H01J 19/38; H01J 19/42; H01J 63/06

[52] U.S. Cl. ..... 313/497; 313/294; 313/302

[58] Field of Search ..... 313/495, 496, 497, 214, 313/294, 302

[56] References Cited

U.S. PATENT DOCUMENTS 2,048,224 7/1936 Snow ..... 313/294 X
2,887,610 5/1959 Smith ..... 313/495 X
3,836,806 9/1974 Kobayakawa et al. ..... 313/497

FOREIGN PATENT DOCUMENTS 3,911,865 7/1964 Japan ..... 313/497

*Primary Examiner*—Palmer C. Demeo
*Attorney, Agent, or Firm*—Oblon, Fisher, Spivak, McClelland & Maier

[57] ABSTRACT

A multi-digit fluorescent display tube is disclosed. The display tube includes a plurality of indicating patterns arranged in a row in spaced side-by-side relational along the longitudinal width of a substrate, a filament stretched along the longitudinal direction of the indicating patterns and a control grid disposed between the filament and the indicating pattern, wherein the control grid is positioned in different plane distances with respect to the filament so as to adjust the perveance in each of the indicating patterns and to obtain an uniform brightness of the indicating patterns.

9 Claims, 8 Drawing Figures

MULTI-DIGIT FLUORESCENT DISPLAY TUBE WITH DIFFERENTLY SPACED PLANAR CONTROL GRID SECTIONS

BACKGROUND OF THE INVENTION

1. Field of the Invention

This invention relates to a multi-digit fluorescent display tube, and more particularly to a fluorescent display tube which is actuated to have a cathode heated by a direct current and suitable for use in small electronic table calculators or electronic clocks of a digital display type.

2. Description of the Prior Art

In general, a fluorescent display tube uses a phosphor which emits fluorescence under irradiation with electrons from a cathode, and exhibits legible display. Thus, it is widely used for digital display in various electronic appliances such as for example electronic calculators or digital clocks. The fluorescent display tube of this type is a thermionic tube having a composite diode or triode structure which includes a filamentous direct heated cathode (hereinafter referred to as a filament) and a plurality of anodes. Each of the anodes is made of segmented electrodes having phosphor layer deposited thereon so as to be able to display a plurality of figures, letters or symbols selectively and arranged in a row to constitute multiple digit indicating patterns, which is opposite to the filament stretched common to all of the indicating patterns. Accordingly, a different potential distribution with respect to the voltage of an operating circuit is created between the filament and each of the segmented anodes constituting the indicating patterns within the voltage applied to the filament. As a result, when the filament is heated and actuated by D.C. power source, the fluorescent display tube is illuminated partially in different brightness. Particularly when the multi-digit display tube having a long filament to which higher heating voltage is applied, the indicating patterns are illuminated in different brightness one after another.

There are two types of driving circuits for the fluorescent display tube, namely dynamic driving circuit and static driving circuit, and either one of which is used in the fluorescent display apparatus. In the dynamic driving circuit, accelerating control grids and provided with respect to each of the indicating patterns to selectively actuate the indicating patterns, and it is sufficient to be provided one decoder even for multi-digit indicating patterns within the apparatus, which applies input signals to the segmented anodes of each of the indicating patterns so as to illuminate the particular letters or numerals as desired. Accordingly, the circuit can be simplified, and the number of LS1 used in the circuit and external terminals of the display tube can be reduced. Because of this, the dynamic driving circuit is widely used for the multi-digit electronic calculators.

In the dynamic driving circuit for the electronic indicating appliances such as for example electronic calculators in which a battery is used as D.C. power source, a convertor is employed to form a direct current voltage (generally higher than the battery voltage) in order to supply a pulse voltage to the anodes and grids through LS1 or the like. In addition, an alternating current voltage for the filament is induced by a transformer used in the convertor, and supplies to the filament to have it heated so as to obtain uniform brightness of the overall indicating patterns. Furthermore, even if the direct current voltage to be required for the anodes and the control grids is lower enough to be able to eliminate the convertor, an inverter for forming an alternating current voltage to be supplied to the filament from the battery must be provided so that each of the indicating patterns is illuminated in uniform brightness.

In the indicating apparatus using the dynamic driving circuit, pulse currents which cause noises flow through the circuit of the apparatus and the fluorescent display tube itself during the operation. Therefore, the dynamic driving circuit would not be applicable to the digital indicating apparatus used to be adjacent to electronic appliances which are adversely affected by the noises.

To the contrary, the static driving circuit dose not use the pulse currents which cause noises, thus it can be satisfactorily used in the digital indicating apparatus built in noise-disliking electronic appliances. A fluorescent display tube applying the static driving circuit thereto includes a plurality of multiple digit indicating patterns, a filament which is stretched opposite to the indicating patterns, and control grids for accelerating electrons and preventing electric charge around the segmented anodes which disturbs normal electric field. Each of the indicating patterns is made of segmented anodes all of which are led out of the tube by means of lead-in wires so as to be able to energize each of the segmented electrodes separately. The control grids for each of the segmented anodes used in the display tube of this type are electrically connected as one body.

In the static driving circuit, it is advantageous that the voltage to be applied to the fluorescent display tube is lower than that to be applied to the dynamic driving circuit in order to obtain the same brightness, which enable to operate the fluorescent display tube by the same D.C. power source as LS1 in the circuit. However, if the filament is energized to be heated by the D.C. power source in the static driving circuit, each of the indicating patterns is illuminated in different brightness as explained hereinabove in connection with the dynamic driving circuit. Accordingly, it was necessary even in the static driving circuit to dispose an inverter or the like within the circuit, which forms an alternating current voltage for heating the filament from a direct current power source such as a battery.

SUMMARY OF THE INVENTION

It is therefore an object of this invention to provide a fluorescent indicating apparatus which is energized by a direct current and applicable to a dynamic driving circuit without having aforementioned conventional problems.

It is a further object of the present invention to provide a fluorescent indicating apparatus which is energized by a direct current and applicable to a static driving circuit without having aforementioned conventional problems.

The foregoing and other objects are achieved according to the present invention by providing a fluorescent indicating apparatus comprising multiple digit indicating patterns arranged in a row in spaced side-by-side relationship, plural grids positioned opposite each of the indicating patterns, and at least one filament as a cathode stretched along the longitudinal direction of the indicating patterns and opposite each of the indicating patterns. The grids are disposed stepwise with respect to the filament so that the distances between the grids and the filament may be changed one digit after another, whereby each of the indicating patterns is illuminated in uniform brightness when the filament is heated and actuated by a direct current power source. In one embodiment of the present invention, the grids for each of the indicating patterns may be electrically connected integrally and disposed in inclined manner so as to change the distances between the grid and the filament one digit after another, whereby each of the indicating patterns is illuminated in uniform brightness when the filament is heated and actuated by a direct current power source using a static driving circuit.

BRIEF DESCRIPTION OF THE DRAWINGS

Further object and advantages of this invention will become apparent from a reading of the following detailed description when considered in connection with the accompanying drawings, wherein.

DESCRIPTION OF THE PREFERRED EMBODIMENTS

Figure 1:
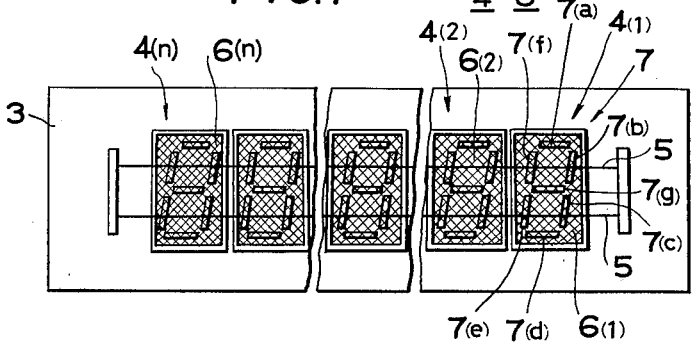
FIG. 1 is a partially cutaway plan view of fluorescent indicating apparatus according to one embodiment of the present invention.
Figure 2:
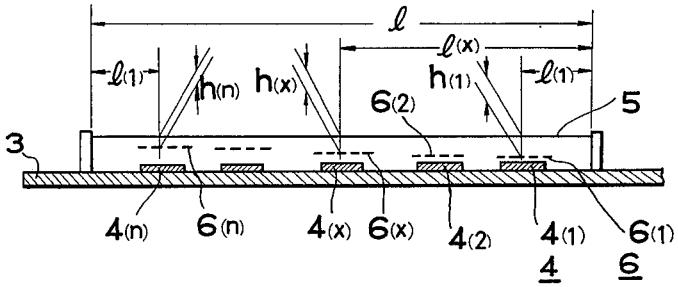
FIG. 2 is a partially cutaway longitudinal sectional view of the fluorescent indicating apparatus shown in FIG. 1.
Figure 3:
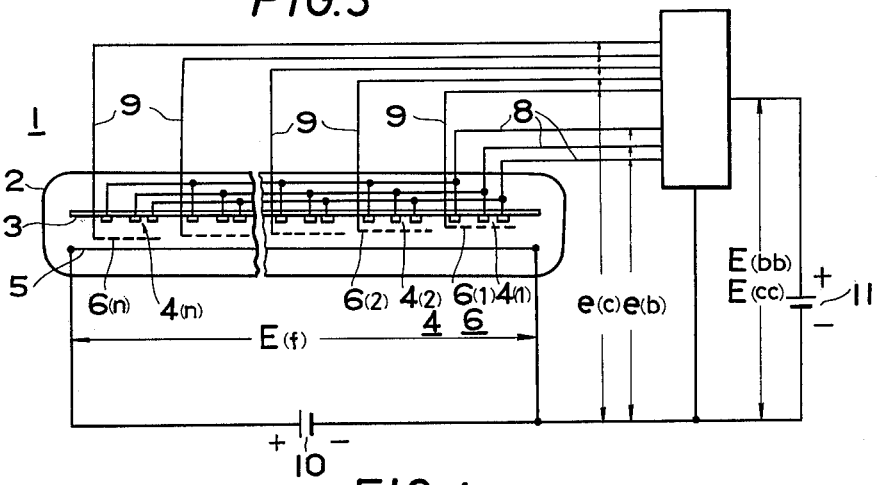
FIG. 3 is a wiring diagram illustrating a principle of circuit applied to the fluorescent indicating apparatus shown in FIG. 1.

Referring now to the drawings, wherein like reference numerals designate identical or corresponding parts throughout the several views, and more particularly FIGS. 1 to 3 thereof, a fluorescent display tube 1 according to one embodiment of the present invention is of a multi-anode triode structure which includes a multi-digit indicating patterns 4 [4(1) . . . 4(n)] disposed on a top surface of substrate 3 spaced in side-by-side relationship, at least one filament 5 stretched along the longitudinal direction of the multi-digit indicating patterns 4 opposite each of the indicating patterns 4(1) to 4(n) substantially in parallel relationship therewith, and plural grids to 6 [6(1) . . . 6(n)] positioned opposite each of the indicating patterns 4 [4(1) . . . 4(n)] between the indicating patterns and the filament 5 within an envelope 2. Each of the indicating patterns 4 [4(1) . . . 4(n)] is made of a plurality of segmented electrodes (anode) 7 [7(a) . . .7(g)] so as to delineate the block digit 8 as shown in FIG. 1 and displays a plurality of letters or numerals as selected. On the surfaces of each of the segmented anodes 7 [7(a) . . . 7(n)], phosphor layers are deposited, which emit fluorescene under irradiation with electrons from the filament 5. Each of segmented electrodes 7(a) to 7(g) forming corresponding sections of the indicating patterns 4 [4(1) . . . 4(n)] disposed in side-by-side relationship is electrically interconnected in series, and led out of the envelope 2 by means of lead-in wires 8. The grids 6 are led out of the external housing 2 by means of lead-in wires 9. Numeral 10 designates a direct current power source which applies a direct current voltage $Ef$ to the filament to have it heated, and numeral 11 designates a direct current power source which applies pulse anode voltage $e$(b) across the filament 5 and segmented anodes 7(a) to 7(g) as selected, and pulse grid voltage $e$(c) across the filament 5 and the grids 6(1) to 6(n) for the indicating patterns 4 as selected.

In the fluorescent display tube tube constructed on the principle of triode as explained hereinabove, the relation between the brightness L of each of the indicating patterns 4 [4(1) . . . 4(n)] and the anode voltage $e$(b) when the grid voltage is $e$(c) is represented by the following formula:

$$L = G \cdot A \cdot e[b]^{2.5} \ldots (1)$$

wherein G denotes the pervance which is determined by the formula $G = B/h^2$ in which $h$ is a distance between the filament and the grid, and B is a constant determined by the geometrical dimensions of the anode. A is a constant determined by factors such as the fluorescence efficiency of the phosphor and the anode area.

In the multi-anode structure in which a plurality of indicating patterns 4 [4(1) . . . 4(n)] are arranged in a row in spaced side-by-side relation so as to opposite to the common filament 5 stretched along the longitudinal direction of the indicating patterns as shown in FIG. 1, an approximate values of the anode voltage $ebx$ and the grid voltage $ecx$ at the indicating pattern 4(x), namely the indicating pattern at $x$ digit from the right, is expressed as follows:

$$ebx = ecx \approx e(b) - (Ef \cdot lx)/l \quad (2)$$

Wherein $l$ is a length between both ends of the filament, and $lx$ is a length of the filament between the right end and the point confronting the indicating pattern 4(x).

When the polarity of the direct current power source 10 for the filament 5 is reverse to that shown in the drawings, values of the anode voltage $ebx'$ and the grid voltage $ecx'$ are expressed as follows:

$$ebx' = ecx' \approx e(b) + (Ef \cdot lx)/l \quad (2)'$$

As is apparent from the foregoing explanations, when the filament 5 is heated by a direct current, anode voltages $e$(b) [$e$(b1) . . . $e$(bn)] applied to each of the indicating patterns 4 [4(1) . . . 4(n)] arranged in spaced side-by-side relation differ one indicating pattern after another. Then, the following relation between the brightness L$x$ at the indicating pattern 4(x) of an optional $x$ digit spaced apart from the right end of the filament 5 by a length $l$(x) shown in FIG. 2 and the distance $h$(x) between the filament and the grid at that position can be derived from the above formula ($b$):

$$h(x) \div C \cdot L(x)^{-1/2} \left( e(b) - \frac{Ef \cdot lx}{l} \right)^{5/4} \ldots \quad (3)$$

Wherein C is a constant determined by factors such as the fluorescence efficiency of the phosphor, anode area, and the geometrical dimensions of the electrodes.

From the above formula (3), it is understood that each of the grids 6 [6(1) . . . 6(n)] may be positioned in a stepwise one after another with respect to the filament so as to obtain the brightness at the position $l$(x) of the indicating pattern 4(x) in order to make the brightness L of each of the indicating patterns uniform.

In the fluorescent display tube 1 according to the present invention, the distances $h(x)$ between the filament and the grid at the respective digit of the indicating patterns 4 [4(1) . . . 4(n)] having the length $l(x)$ are calculated from the formula (3), and the grids 6 [6(1) . . . 6(n)] are disposed in the stepwise with respect to the filament 5 at positions substantially close to the value calculated from the formula (3) so as to cover one or more digits of the indicating patterns. Then, the brightness L [L(1) . . . L(n)] of each of the indicating patterns 4 [4(1) . . .4(n)] are substantially uniform when the fluorescent display tube 1 is actuated to have the filament 5 heated by the direct current power source 10.

The values of the distances $h(x)$ between the grids 6 [6(1) . . .6(n)] and the filament 5 practically used in the present invention are preferably within an extent of about ±10% of the actual values calculated from the above formula (3). If the grids are disposed within this extent, the deviation of the brightness L(1) to L(n) among the indicating patterns 4(1) to 4(n) can be controlled approximately within 20% provided that influences due to other factors are omitted, which makes it possible to substantially uniform the visual brightness of each of the indicating patterns.

The fluorescent display tube according to the present invention will now be described in connection with an embodiment having the indicating patterns of six digits and its numerical values.

The fluorescent display tube shown in FIGS. 1 to 3 includes the filament 5 having the length $l$ of 80mm, the lengths $l(1)$ from both ends of the filament to both ends of the indicating patterns of 12mm, $e$(b) and $e$(c) of 20V, E(f) of 3V, and the distance h(1) between the filament 5 and the grid 6(1) of 2.3 mm, which is the first digit of the indicating pattern 4(1) on the right end. If the grids 6(1) to 6(6) are disposed to have the same distance $h(1)$ of 2.3mm as the right end digit with respect to the filament 5 for each of the indicating patterns 4(1) to 4(6), the brightness of each of the indicating patterns 4(1) to 4(6) is gradually darker from the right end indicating pattern to the left end indicating pattern, and the brightness L6 of the left end indicating pattern 4(6) is approximately 33.4% darker than the brightness L1 of the right end indicating pattern 4(1).

In order to make the brightness of all of the indicating patterns substantially equal to the brightness L1 of the first digit of the indicating pattern 4(1) on the right end, the distances $h(2)$ to $h(6)$ between the filament 5 and the grids 6 for each of the indicating patterns can be calculated from the formula (3). The approximate values of the distances $h(2)$ to $h(6)$ are as follows:

$h(2)$ — 2.24mm, $h(3)$ — 2.18mm, $h(4)$ — 2.12mm $h(5)$ — 2.06mm, $h(6)$ — 2.00mm

Accordingly, in the fluorescent display tube of the present invention, the grids 6(1) to 6(6) may be disposed in the stepwise to have the distances between the grids 6(1) to 6(6) and the filament 5 for each of the indicating patterns 4(1) to 4(6) met the numerical values obtained from the formula (3).

As a matter of actual practice, the grids may be formed so as to be disposed in the stepwise with respect to the filament 5 to cover one or more digits based on the numerical values obtained from the formula (3), for example:

| | | | | |
|---|---|---|---|---|
| Example 1: | h(1) | 2.3mm, | h(2) | 2.25mm |
| | h(3) | 2.2mmm, | h(4) | 2.1mm |
| | h(5) | 2.05mm, | h(6) | 2.0mm |

-continued

| | | |
|---|---|---|
| Example 2: | h(1) and h(2) | 2.3mm |
| | h(3) and h(4) | 2.15mm |
| | h(5) and h(6) | 2.0mm |
| Example 3: | h(1) | 2.3mm |
| | h(2) and h(3) | 2.2mm |
| | h(4) and h(5) | 2.1mm |
| | h(6) | 2.0mm |

When energizing the fluorescent display tube in which there exists a variation of the distances $h(1)$ to $h(6)$ between the filament 5 and the grids 6(1) to 6(6) to have the filament 5 heated by the direct current power source, the deviation of the brightness L1 to L6 of each of the indicating patterns 4(1) to 4(6) caused by the application of the round numerical values as explained hereinabove is approximately within 10%, and it is possible to obtain such an uniform brightness of the indicating patterns that could not discriminate the differences in brightness visually.

Figure 4:
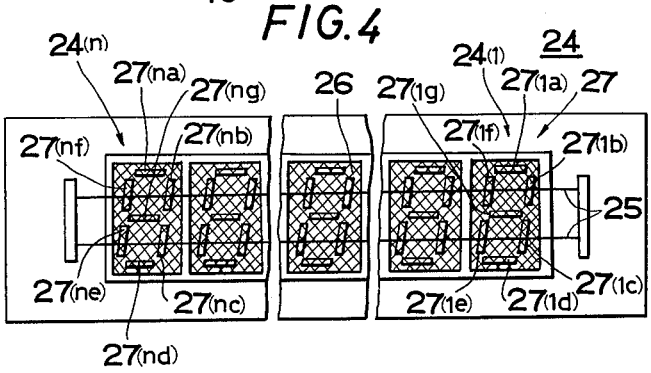
FIG. 4 is a partially cutaway plan view of another embodiment of a fluorescent indicating apparatus according to the present invention.

Now, the another embodiment of the present invention will be described in conjunction with FIGS. 4 to 8. A fluorescent display tube generally indicated by the reference numeral 21 includes a multi-digit indicating patterns 24 [24(1) . . .24(n)] disposed on a top surface of substrate 23 spaced in side-by-side relation, at least one filament 25 stretched along the longitudinal direction of the multi-digit indicating patterns opposite each of the indicating patterns 24 [24(1) . . . 24(n)] substantially in parallel relationship therewith, and a control grid 26 disposed between the plurality of the indicating patterns 24 and the filament 25 within an envelope 22. The fluorescent display tube 21 is of a triode structure. Each of the indicating patterns 24(1) to 24(n) is made of a plurality of segmented electrodes (anode) 27 [27(1a) to 27(1g) . . . 27(na) to 27 (ng)] so as to delineate the block digit 8 as shown in FIG. 4 and forms indicia selectively to display a plurality of letters or numerals. On the surfaces of each of the segmented anodes 27, phosphor layers are deposited, which emit fluorescence under irradiation with electrons from the filament 5. Each of the segmented anodes 27(1a) . . . 27(ng) is lead out of the envelope 22 by means of a plurality of lead-in wires 28. The grids for each of the indicating patterns 24(1) to 24(n) are integrally connected and led out of the envelope 22 by means of a lead-in wire 29. Numeral 30 is a direct current power source which applies a direct current voltage E(f) to the filament to have it heated. Numeral 31 designates a direct current power source which applies accelerating grid voltage E(c) and anode voltage E(b) across the filament 25, the grid 26 and the selected indicating pattern 24.

In order to make brightness L(L1 . . . Ln) of each of the indicating patterns 24 [24(1) . . . 24(n)] uniform in the fluorescent display tube according to this embodiment the grid 26 may be positioned with respect to the filament 25 so as to meet the values $h(x)$ between the filament and the grid at the positions $l(x)$ of each of the indicating patterns which are calculated from the formula (3) of the preceding embodiment.

In the embodiment of the fluorescent display tube 21 shown in FIGS. 4 to 8, the distances $h(x)$ between the filament and the grid at the respective digit of the indicating patterns having the length $l(x)$ are calculated from the formula (3), and the grid 26 are disposed to be slanted against the filament 25. Then, the brightness L (L1 . . . Ln) are substantially uniform when the fluorescent display tube 121 is actuated to have the filament 25 heated by the direct current power source 30.

The values of the distances $h(1) \ldots h(n)$ between the filament 25 and the grid 26 at the respective indicating patterns 24 [24(1) . . . 24(n)] practically used in the present invention are preferably within an extent of about ±10% of the actual values calculated from the above formula (3). If the grid 26 is disposed with respect to the filament 25 to have the distances $h(1)$ to $h(n)$ within this extent, the deviation of the brightness L(1) to L(n) of each of the indicating pattern can be controlled approximately within 20% provided that influences due to other factors are omitted, which makes it possible to substantially uniform the visual brightness of each of the indicating patterns.

Figure 5:
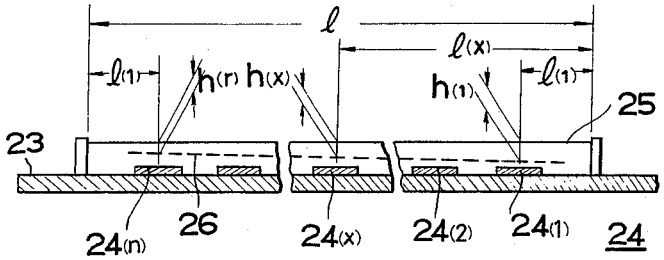
FIG. 5 is a partially cutaway longitudinal sectional view of the fluorescent indicating apparatus shown in FIG. 4.

In the fluorescent display tube of the present invention wherein each of the grid for the indicating patterns 24 is integrally connected and disposed with respect to the filament so as to obtain the uniform brightness of the indicating patterns as shown in FIG. 5, the distances $h(1)$ and $h(n)$ between the filament 25 and the grid 26 at the both ends of the indicating patterns 24 (1) and 24(n) are calculated from the formula (3), and the grid 26 disposed in a slanted manner so that the ends of the grid may be located at the positions having the distances $h(1)$ and $h(n)$. If the grid 26 is disposed in this manner, the distances $h(x)$ between the filament 25 and the grid 26 at the intermediate indicating patterns are adjusted one after another and approach to the values calculated by the formula (3). Accordingly, the deviation of the brightness at the intermediate indicating patterns with respect to the both ends of the indicating patterns 24(1) and 24(n) can be reduced, which enables the brightness of the indicating patterns of uniform.

The fluorescent display tube according to the present invention will now be described in conjunction with an embodiment having the indicating patterns of five digits and its numerical values.

Figure 6:
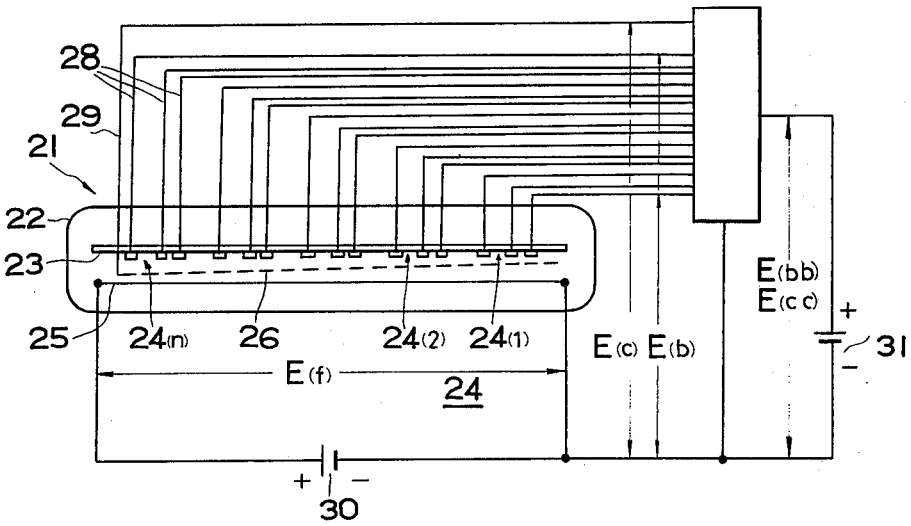
FIG. 6 is a wiring diagram illustrating a principle of circuit applied to the fluorescent indicating apparatus shown in FIG. 4.

The fluorescent display tube shown in FIGS. 4 to 6 includes the filament 25 having the length $l$ of 80mm, the lengths $l(1)$ from both ends of the filament to both ends of the indicating patterns of 12mm, E(b) of 20V, E(f) of 3V, and the distance $h(l)$ between the filament and the grid of the first digit of the indicating pattern 24(1) on the right end at the location $l(1)$ of 2.3mm. If the grid 26 is disposed in parallel to the filament 25 so as to make the distance $h(5)$ between the filament 25 and the grid 26 at the fifth indicating pattern 24(5) on the left end the same as the distance $h(1)$ which is 2.3mm, the brightness L5 of the fifth indicating pattern 4(5) calculated by the formula (1) is darker by about 33.4% than the brightness L1 of the first indicating pattern 24(1).

In order to make the brightness L5 of the indicating pattern of the fifth digit on the left end equal to the brightness L1 of the first digit on the right end, the distance $h(5)$ between the grid 26 and the filament 25 at the fifth indicating pattern 24(5) is calculated from the formula (3) as 2.0mm.

Then, both the distances $h(1)$ and $h(5)$ between the filament 25 and the grid 26 at that positions are set to 2.3mm to 2.0mm respectively, and the grid 26 is disposed in the slanted manner so as to make the brightness of the both ends of the indicating patterns $h(1)$ and $h(5)$ uniform. The distance $h(3)$ between the filament 25 and the grid 26 at the central indicating pattern 24(3) includes an error within 1% based on the value calculated from the formula (3). The deviation of the brightness L(3) with respect to the brightness L1 and L2 of the both ends of the indicating patterns 24(1) and 24(5) is approximately 2%. Accordingly, no visual difference in brightness is recognized throughout the indicating patterns.

Figure 7:
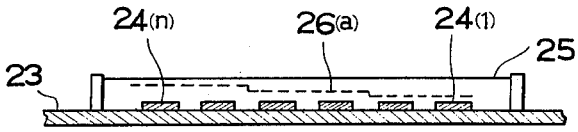
FIGS. 7 and 8 are longitudinal sectional views of modifications of the fluorescent indicating apparatus according to the present invention.
Figure 8:
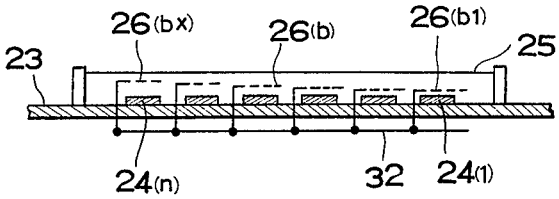

In the embodiment of the present invention as explained hereinabove, the grid to be disposed between the filament 25 and the plural indicating patterns 24 is shown as a sheet of plate which is integrally connected and disposed in a slanted manner in the same plane, however the grid should not be limited to this particular shape and many modifications or variations of the grid are possible as shown in FIGS. 7 and 8. For example, the grid 26(a) may be disposed in a stepwise in parallel to the filament 25 so as to cover one or more digits as shown in FIG. 7.

The grid 26(b) may be divided into plural grids 26(b1) to 26(bn) which cover one or more digits and disposed in a stepwise in parallel to the filament 5, and the grids 26(b1) to 26(bn) are integrally connected by a conductor or wiring 32 so as to be connected to an outer circuit.

In the embodiments of the fluorescent display tube as illustrated hereinabove, explanations have not been made in detail as to how the substrate on which a plurality of the indicating patterns, the grids and the filament are disposed is incorporated in the envelope. As to the arrangement of the functional elements of the fluorescent display tube within the envelope, many modifications and variations are possible. For example, the substrate may be contained within the envelope or a base portion of the envelope may be formed by the substrate.

According to the present invention, when the fluorescent display tube is used in appliances actuated by a direct current power source, it is not required to provide an inverter or the like for forming alternating current for heating the filament with the driving circuit of the fluorescent display tube, and the filament can be heated by a direct current power source such as a battery. Accordingly, it is possible for the display tube according to the present invention to minimize and simplify the driving circuit, which results in a reduction of cost. Thus, it can be advantageously used for a digital display in various electronic appliances such as a multiple digit electronic or a measuring apparatus.

Also, it is possible to energize the fluorescent display tube by making the anode and the grid voltages the same as the filament voltage derived, for example, from a battery placed on a car. Therefore, the fluorescent display tube of the present invention can be easily applied to a digital clock for a car or other measuring instruments in which legible digital displays can be obtained with a single battery power source and a relatively simple driving circuit.

Whereas the fluorescent display tube according to the present invention can be actuated with a single direct current power source and a static driving circuit which does not create noises, it can be easily applied to a digital clock built in a radio.

Obviously, many modifications and variation of the present invention are possible in light of the above teachings. It is to be understood therefore that within the scope of the appended claims, the invention may be practiced otherwise than as specifically described herein.

What is claimed as new and desired to be secured by letters patent of the United States is:

1. A multi-digit fluorescent display tube comprising:
a substrate;

a plurality of multi-digit indicating patterns arranged in a row in spaced side-by-side relationship along the longitudinal width of said substrates, each of said indicating patterns comprising a plurality of segmented anodes on which phosphor layers are deposited;

at least one electron emitting filament stretched along the longitudinal direction of said indicating patterns so as to be in parallel and opposite to each of said indicating patterns;

a control grid comprised of a plurality of planar sections disposed between said filament and said indicating patterns, said planar sections of said control grid being positioned at different distances with respect to said filament; whereby the perveance of each of said indicating patterns is adjusted so as to illuminate each of said indicating patterns in uniform brightness when said fluorescent display tube is energized by heating said filament with a direct current power source;

a light transparent evacuated sealed envelope in which the anodes, the filament and the control grid are disposed and through which the display may be viewed externally when the display tube is in operation.

2. A multi-digit fluorescent display tube as in claim 1, wherein the planar sections of the control grid form a continuous element which is at an acute angle with the plane of the substrate.

3. A multi-digit fluorescent display tube as in claim 1, wherein the planar sections of the control grid form a star-like configuration of alternating horizontal steps and vertical risers.

4. A multi-digit fluorescent display tube as in claim 3, wherein each step of said control grid is disposed opposite one of said indicating patterns.

5. A multi-digit fluorescent display tube as in claim 3, wherein each step of said control grid is disposed opposite several indicating patterns.

6. A multi-digit fluorescent display tube as in claim 1, wherein each of the planar sections of the control grid is separately connected to a power source.

7. A multi-digit fluorescent display tube as in claim 6, wherein each of the planar sections of the control grid is disposed opposite several indicating patterns.

8. A multi-digit fluorescent display tube as in claim 1, wherein the planar sections of the control grid are positioned with respect to said filament at distances $hx$ which are obtained by the following formula:

$$hx = C\,Lx^{-1/2}\,[(Eb - (Ef \cdot lx)]^{5/4}$$

wherein C is a constant determined by the fluorescent efficiency of the phosphor, the anode area, and the geometrical dimensions of the electrodes; $Lx$ is the brightness of any one of the selected indicating patterns; $Eb$ is the anode voltage of any one of the selected indicating patterns; $l$ is the length between both ends of the filament; $Ef$ is the filament voltage; and $lx$ is the length of the filament between the right end of the filament and a point confronting any one of the selected indicating patterns when the leftmost planar section of the control grid is disposed closest to the filament and the rightmost planar section of the control grid is disposed farthest from the filament.

9. A multi-digit fluorescent display tube as in claim 8, wherein the planar sections of the control grid are disposed with respect to said filament at distances within a range of ± 10% of the values $hx$.

* * * * *